US010030855B1

(12) United States Patent
Khubani

(10) Patent No.: US 10,030,855 B1
(45) Date of Patent: Jul. 24, 2018

(54) PORTABLE LIGHT

(71) Applicant: Telebrands Corp., Fairfield, NJ (US)

(72) Inventor: Ajit Khubani, Saddle River, NJ (US)

(73) Assignee: Telebrands Corp., Fairfield, NJ (US)

( * ) Notice: Subject to any disclaimer, the term of this patent is extended or adjusted under 35 U.S.C. 154(b) by 0 days.

(21) Appl. No.: 15/461,305

(22) Filed: Mar. 16, 2017

(51) Int. Cl.

| | |
|---|---|
| ***F21V 21/08*** | (2006.01) |
| ***F21L 4/00*** | (2006.01) |
| ***F21V 23/02*** | (2006.01) |
| ***F21V 23/04*** | (2006.01) |
| *F21Y 115/10* | (2016.01) |

(52) U.S. Cl.
CPC ..... *F21V 21/08* (2013.01); *F21L 4/00* (2013.01); *F21L 4/005* (2013.01); *F21V 23/023* (2013.01); *F21V 23/0414* (2013.01); *F21V 23/0471* (2013.01); *F21Y 2115/10* (2016.08)

(58) Field of Classification Search
CPC .. F21L 4/00; F21L 4/005; F21V 21/08; F21V 23/023; F21V 23/0414; F21V 23/0471; F21Y 2115/10
See application file for complete search history.

(56) References Cited

U.S. PATENT DOCUMENTS 8,525,395 B2 * 9/2013 Muessli ..... F21V 29/004 313/46

* cited by examiner

*Primary Examiner* — Stephen F Husar
(74) *Attorney, Agent, or Firm* — Cooper & Dunham LLP

(57) ABSTRACT

A portable lighting device including a lighting assembly including a chip-on-board (COB) light emitting diode (LED) light source, a power source providing power to the COB LED light source, and a switch controlling an operation of the COB LED light source. The COB LED light source being configured in a substantially circular configuration.

2 Claims, 2 Drawing Sheets

PORTABLE LIGHT

BACKGROUND

Additional lighting can be desirable in many locations. Lighting can be desirable to provide permanent and temporary lighting. For example, closets, attics, basements, cabinets, crawl spaces, etc. can be dimly lit and can require additional lighting. Alternatively, temporary lighting can be desirable in low-light circumstances such as working on a vehicle, performing maintenance, etc. Adding additional light, however, can be difficult and expensive. Hiring electricians to wire and install lighting fixtures can be expensive, time-consuming and inconvenient. Further, flashlights and other portable lights may be cumbersome to use and may not provide a sufficiently bright or wide-angled light with adequate coverage.

SUMMARY

Exemplary embodiments of the present invention can provide a novel portable lighting device. The exemplary lighting device can include a lighting assembly having a chip-on-board (COB) light emitting diode (LED) light source, a power source providing power to the COB LED light source, and a switch controlling an operation of the COB LED light source. Further, the COB LED light source can be configured in a substantially circular configuration.

According to certain embodiments, portable lighting device can further include comprising a mounting element, which can be at least one of a magnet, a hook, an adhesive tape, and hook-and-loop fasteners. The hook can be pivoting.

Further, the power source can include a battery, and the lighting device can further include a removable rear panel, with the battery being housed within the removable rear panel.

According to certain embodiments, the lighting assembly can include a reflective surface and a light transmissive face. Further, the lighting assembly can be telescopically movable relative to a housing of the lighting device to actuate the switch. Further, the lighting device can further include a motion detector configured to control the switch.

Another embodiment of the present invention can provide a portable lighting device including a lighting assembly including a chip-on-board (COB) light emitting diode (LED) light source, the COB LED light source being configured in a substantially circular configuration, a power source providing power to the COB LED light source, and a switch controlling an operation of the COB LED light source, where the switch can be actuatable via a telescoping displacement of the lighting assembly.

BRIEF DESCRIPTION OF THE DRAWINGS

The features and advantages of the present invention can be more readily understood from the following detailed description with reference to the accompanying drawings, wherein.

DETAILED DESCRIPTION

Exemplary embodiments of the present invention can provide a novel portable lighting device. An embodiment of the present invention can provide a portable lighting device that can be used as a temporary or permanent/semi-permanent lighting solution wherever additional lighting is desired or necessary.

Figure 1:
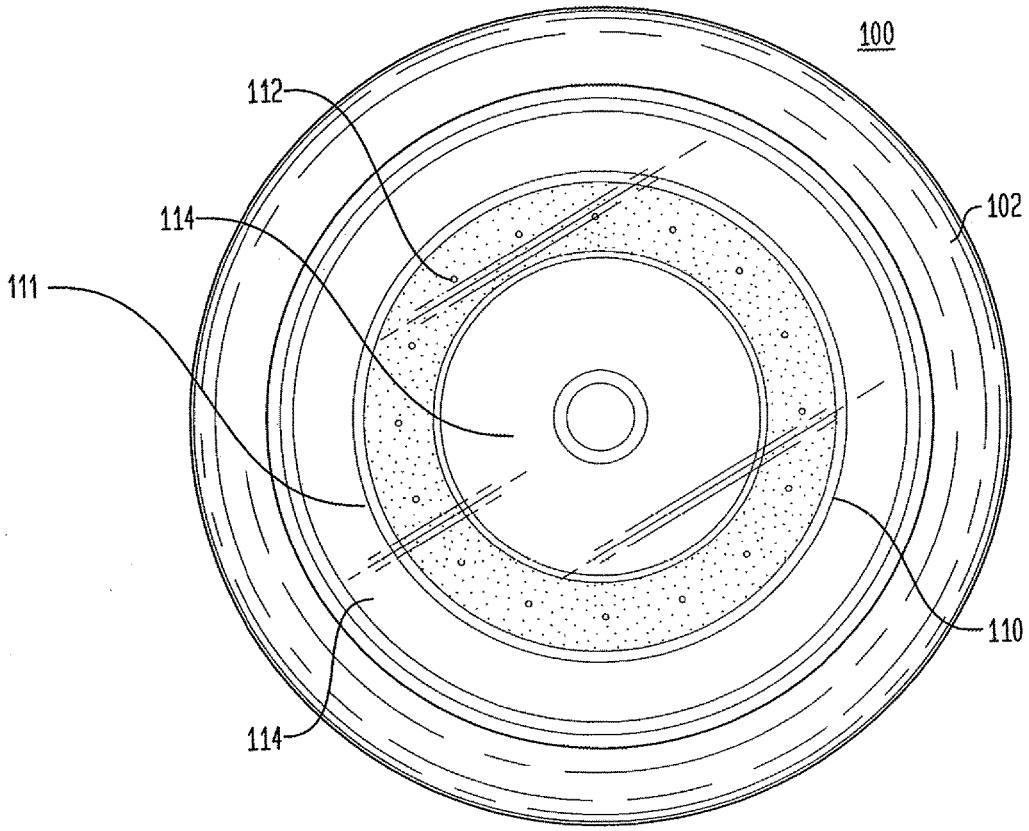
FIG. 1 is a diagram of an exemplary portable light according to one embodiment of the present invention.
Figure 2:
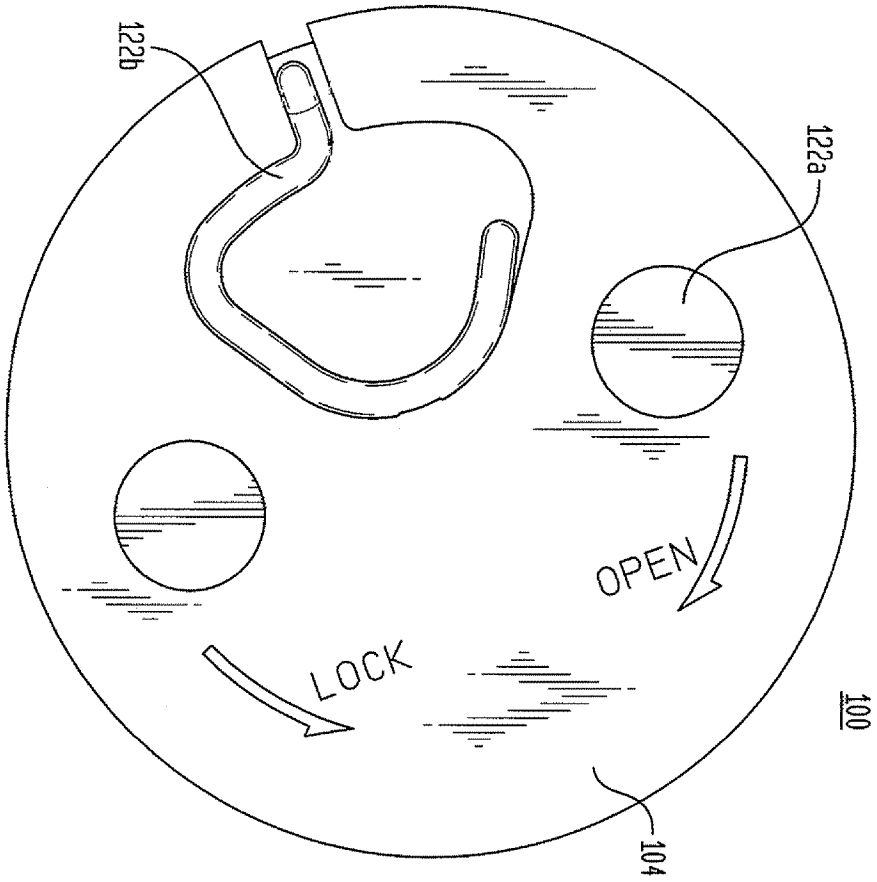
FIG. 2 is a diagram of an exemplary portable light according to one embodiment of the present invention.

FIGS. 1 and 2 show an exemplary portable lighting device 100 according to an embodiment of the present invention. As shown in FIGS. 1 and 2, portable lighting device 100 can be substantially circular and can include housing 102, light assembly 110, removable cover 104, and mounting elements 122*a* and 122*b*. Although portable lighting device 100 can be substantially circular, portable lighting device can take be in any desired shape (e.g., rectangular, square, diamond, X-shaped, etc.). Light assembly 110 can include a light transmissive cover 111, light source 112, and reflective surfaces 114. Further, portable lighting device 100 can include a switch and a power supply. In operation, portable lighting device 100 can be controlled via operation of the switch, which can activate light source 112. The power supply can include any power supply capable of supplying the power necessary to power portable lighting device 100. Preferably, the power supply includes a battery (e.g., rechargeable, alkaline, etc.). Alternatively, the power supply can include an electrical connection to an external power supply. For example, the power supply can include a cord to be plugged into a standard 120V outlet. Alternatively, the power supply can include solar panels and utilize solar power to power portable lighting device 100.

According to one embodiment, the switch can include a pressure switch and light assembly 110 can be configured to be telescopically movable relative to housing 102 and movement of light assembly 110 can cause actuation of the switch. For example, a user can press on the light transmissive cover 111 of light assembly 110, which in turn can telescopically displace light assembly 110 within housing 102 to actuate the switch and control operation of portable light assembly 110. A first actuation of the switch can cause light source 112 to turn ON, and a second actuation of the switch can cause light source 112 to turn OFF. Portable lighting device 110 can include other modes of operation (e.g., strobing, timer, etc.), which can also be controlled via actuation of the switch. According to another embodiment, portable lighting device 100 can include a motion detector which can control operation of the light. For example, the motion detector can activate the light upon detection of motion and maintain the light in an activated condition until a certain time period after motion is no longer detected (e.g., 10 seconds, 15 second, 30 second, 60 second, etc.). Additionally, portable lighting device 100 can also include a timer to enable the light to be operated in accordance with defined timing intervals.

As shown in FIG. 1, according to certain exemplary embodiments, light source 112 of light assembly 110 can include any known light sources, such as light-emitting diodes (LEDs), etc. According to certain exemplary embodiments, light source 112 of light assembly 110 can be configured in a substantially circular configuration. Preferably, light source 112 includes chip-on-board (COB) LEDs arranged in a substantially circular arrangement. Further, light source 112 and reflective surfaces 114 can be configured and arranged and to create any desired light. For example, reflective surfaces 114 can include features (e.g., concavities, curvatures, etc.) which can focus and direct the light produced by light source 112 to create any desired light pattern with the light produced by light source 112. For example, light source 112 and reflective surfaces 114 can be configured and arranged to focus the light into a narrow beam. Alternatively, light source 112 and reflective surfaces

114 can be configured and arranged to create a wide area of light to provide light to a large area.

As shown in FIG. 2, portable lighting device 100 can also include a removable cover 104. Removable cover 104 can be removably coupled to housing 102 to provide access to the interior of portably lighting device 100. For example, the power supply (e.g., a battery) can be accessed by removing removable cover 104. Removable cover 104 can be removably coupled to housing 102 via any coupling mechanism, such as a lock and groove mechanism, snaps, etc. According to certain exemplary embodiments, removable cover 104 can include weather-proofing elements to prevent moisture, dust, etc. from entering the interior of housing 102.

Portable lighting device 100 can further include mounting elements 122*a* and 122*b*. According to certain embodiments, mounting elements 122*a* and 122*b* may be disposed in removable cover 104. Alternatively, mounting elements 122*a* and 122*b* may be disposed on any portion of portable lighting device 100. As shown in FIG. 2, mounting elements 122*a* and 122*b* can include, for example, a hook, one or more magnets, hook-and-loop type fasteners, adhesive tape, clips, and the like. Mounting elements 122*a* and 122*b* can be used to removable secure portable lighting device 100 in locations where light is desired. For example, the hook can be used to hang portable lighting device 100 to a nail or a screw. According to certain exemplary embodiments, the hook may be pivotally coupled to portable lighting device 100 so that it can be pivoted and swiveled to adjust the mounting of portable lighting device 100. Alternatively, the magnets can be used to removably secure portable lighting device 100 to a metal surface.

The embodiments and examples shown above are illustrative, and many variations can be introduced to them without departing from the spirit of the disclosure. For example, elements and/or features of different illustrative and exemplary embodiments herein may be combined with each other and/or substituted with each other within the scope of the disclosure. For a better understanding of the disclosure, reference should be had to any accompanying drawings and descriptive matter in which there is illustrated exemplary embodiments of the present invention.

The invention claimed is:

1. A portable lighting device, comprising:

a housing;

a lighting assembly disposed within the housing, the lighting assembly including a chip-on-board (COB) light emitting diode (LED) light source configured in a substantially circular ring-shaped configuration; and a mounting element including a pivoting hook disposed on the housing.

2. The lighting device of claim 1, wherein the lighting assembly includes a reflective surface and a light transmissive cover.

* * * * *